United States Patent [19]

Shield

[11] Patent Number: 4,850,501

[45] Date of Patent: Jul. 25, 1989

[54] DISPENSING CONTAINER

[75] Inventor: Frank H. Shield, Loveland, Ohio

[73] Assignee: The Procter & Gamble Company, Cincinnati, Ohio

[21] Appl. No.: 125,026

[22] Filed: Nov. 24, 1987

[51] Int. Cl.[4] ..... A47G 19/22

[52] U.S. Cl. ..... 220/90.4; 222/569

[58] Field of Search ..... 220/90.2, 90.4, 90.6; 222/567, 569, 570

[56] References Cited

U.S. PATENT DOCUMENTS

| | | | |
|---|---|---|---|
| 1,156,784 | 10/1915 | King | 222/566 |
| 1,933,471 | 10/1933 | Crook | 222/567 |
| 2,069,089 | 1/1937 | Goldman et al. | 220/90.2 |
| 2,431,059 | 11/1947 | Marshall | 220/90.2 |
| 2,503,308 | 4/1950 | Wiener et al. | 222/572 |
| 2,600,479 | 6/1952 | Campomar | 220/90.4 |
| 2,601,767 | 7/1952 | Wall | 220/90.4 |
| 2,640,337 | 6/1953 | Bryant | 222/572 |
| 2,640,628 | 6/1953 | Klosky | 222/158 |
| 2,982,450 | 5/1961 | Whitton, Jr. | 222/540 |
| 3,309,000 | 3/1967 | Haverstick | 222/569 |
| 3,463,366 | 8/1969 | Spencer | 222/570 |
| 3,800,999 | 4/1974 | Serritella | 220/90.2 X |
| 4,235,348 | 11/1980 | Watson | 220/90.4 |
| 4,467,938 | 8/1984 | Allen | 220/270 |

*Primary Examiner*—Stephen Marcus
*Assistant Examiner*—Nova Stucker
*Attorney, Agent, or Firm*—R. C. Witte; T. H. O'Flaherty; J. V. Gorman

[57] ABSTRACT

An improvement to a wide mouth container for powdered or granular products is disclosed. Attached to the neck of the container in a spaced relationship are two flat, lens-shaped projections having opposed surfaces generally normal to the container axis. Between the projections a dispensing slot is formed which is useful to effect dispensing by pouring. Alternatively, the size and spacing of the projections allows a spoon to be inserted into the container neck for dispensing the product. The projections do not interfere with the sealing means which closes the container.

8 Claims, 3 Drawing Sheets

DISPENSING CONTAINER

FIELD OF THE INVENTION

This invention relates to containers for granular products, and, more particularly, to containers from which the granular product is dispensed by pouring or spooning.

BACKGROUND OF INVENTION

Household products are typically sold in and dispensed from the same container. If the product is granular in form, dispensing the product from the container presents certain difficulties. For example, if the container is nearly full and is tilted slightly to cause some of the product to be dispensed by pouring, excess product may spill out of the container and be wasted.

Similarly, if the container is nearly empty and one tries to dispense the remaining product by tilting and shaking the container, spillage may again result. Another approach to dispense the remaining granular product is to insert a spoon into the container and remove a spoonful of the product from the container. Alternatively, one can dispense the remaining granular product from a nearly empty container into a new container of the same product. This approach is not always convenient if one does not have a new container of the same product available.

One approach to dispensing granular products from a container has been to provide a narrow neck and a small opening at the top of the container, rather than a generally constant cross-section. However, this configuration can interfere with dispensation of the product by using a spoon, as described above.

Another approach is U.S. Pat. No. 2,640,628 issued to Klosky on June 2, 1953, which shows a container having an internal pouring channel formed by vertically oriented eccentric offsets. These offsets provide a channel for pouring fluids in a narrow stream. However, since the offsets are vertical, they do not prevent inadvertent large scale spillage of the contents of the container if it is tipped too far while dispensing.

U.S. Pat. No. 2,982,450 issued to Whitton, Jr. on May 2, 1961, shows a container having an annular internal rim, shaped to provide a weir to direct the flow of liquid out of the container. However, this arrangement does not provide sufficient obstruction to prevent spillage of the product when the container is tipped too far since the underside of the annular rim is arcuate in vertical section. This arrangement also includes wasted material by having the rim continue around the perimeter of the container 360° providing material that serves no beneficial purpose to prevent spillage of the contents during dispensation.

BRIEF SUMMARY OF THE INVENTION

It is an object of this invention to provide a means for dispensing a granular product from a container with reduced spillage. It is further an object of this invention to allow the user to dispense the product with a spoon or by pouring. It is also an object of this invention to not interfere with the sealing means which closes the container.

The invention is a container which has a body with a central longitudinal axis, a closed bottom and a neck at the top. The neck has a planar mouth with a pair of transversely extending planar projections affixed adjacent thereto. The projections have an axially downwardly facing surface that is generally normal to the axis of the body. A dispensing slot is formed between the pair of projections along the interior of the neck.

BRIEF DESCRIPTION OF THE DRAWINGS

While the specification concludes with claims particularly pointing out and distinctly claiming the present invention, it is believed the same will be better understood from the following description taken in conjunction with the accompanying drawings wherein like parts will be given the same reference number in the different figures:

DETAILED DESCRIPTION OF THE INVENTION

The invention relates to a container 10, which is used to sell, contain and dispense powdered or granular household products. For example, such a product may be a direct ground natural seedhusk or a previously processed mucilloid having a particle size typically ranging from 50 to 1,000 microns.

Figure 1:
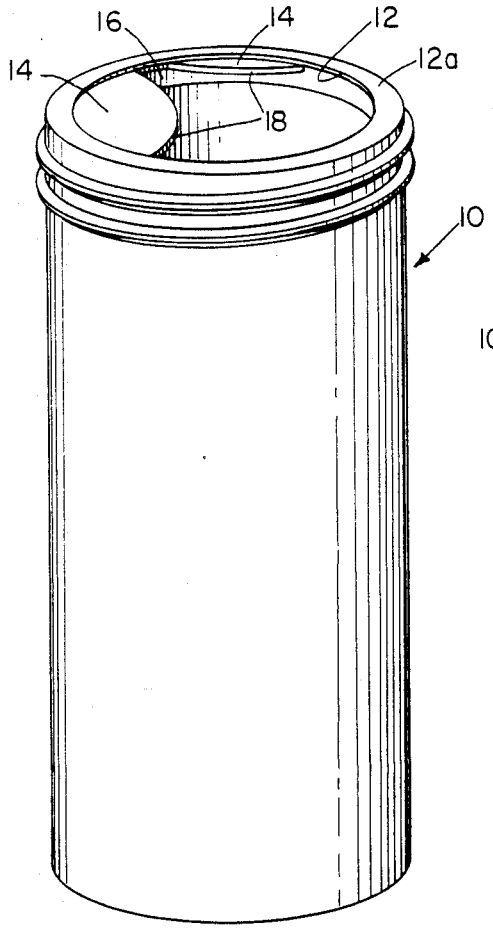
FIG. 1 is a perspective view of an embodiment of the container of the present invention with the dispensing slot oriented away from the viewer.
Figure 2:
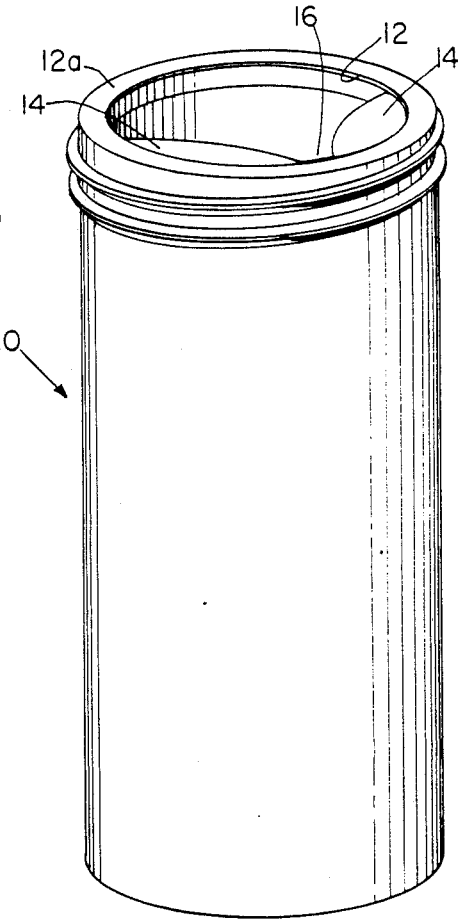
FIG. 2 is a perspective view of the embodiment of FIG. 1 wherein the container has been rotated approximately 180° about the vertical axis.

As shown in FIGS. 1 and 2, the container 10 has a generally cylindrical body with a central longitudinal axis extending therethrough. A container having a diameter of about 57.9 mm (2.28 inches) and a height of about 161 mm (6-11/32 inches) is sufficient to hold approximately 211 to 397 grams (7.4 to 14 oz.) of the aforementioned product. A high density polyethylene extrusion blow molded container, having an average vertical sidewall thickness ranging from about 0.6 mm (0.025 inches) to 1.1 mm (0.045 inches) and a minimum thickness at any location of about 0.5 mm (0.018 inches) is suitable for this invention. The container body has a bottom which is generally perpendicular to the central longitudinal axis and closes the container 10. At the top of the container 10 is a neck 12, from which the granular product is dispensed. The neck 12 of the container body has a planar mouth **12*a*** at its distal end which is generally perpendicular to the central longitudinal axis.

The mouth **12*a* is adapted to engage a sealing means (not shown) such as a lid, to preserve the product in a fresh condition and prevent the product from being spilled when the container 10 is not in use. The sealing means is preferentially accomplished by an external screw thread on the neck of the container 10** which engages an internal screw thread on the lid.

Extending transversely from the interior of neck 12 are two projections 14 which are welded, glued or otherwise affixed to container 10. The projections 14 are generally planar and have two opposed surfaces which are generally normal to the container 10 axis. The inner surface of the projections 14 faces axially downwards such that it faces the product in the container 10. The outer surface faces axially upwards, away from the container body. The projections 14 are spaced from one another, forming a dispensing slot 16 therebetween.

When the container 10 is tilted from the upright position to effect dispensing by pouring, the dispensing slot 16 is preferentially in the lowermost position on the container neck 12, corresponding to the six o'clock position on a watch face. The projections 14 restrain granular product from being spilled as it is poured through the slot 16 between the projections 14 or spooned from the container 10. The product in the tilted container will encounter the inner surface of the projections 14 and conform to the contour of the interior sides of the container 10 without spillage.

Figure 3:
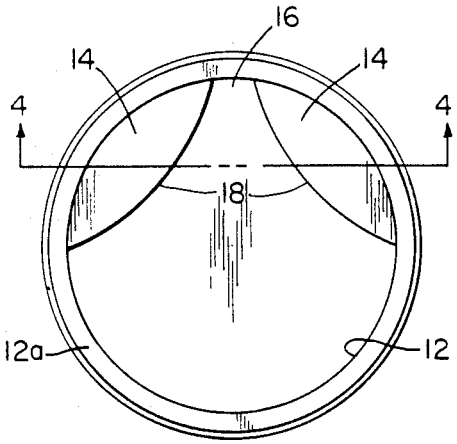
FIG. 3 is a top plan view of the embodiment of FIGS. 1 and 2 with the dispensing slot at the twelve o'clock position.

Referring to FIG. 3, in profile each planar projection 14 is preferentially continuously convex shaped. This shape is selected because it generally agress with the configuration in which a granular product is distributed through the cross section of the container 10, in the region near the neck 12, when the container 10 is tipped for pouring and it allows sufficient space for a spoon to be inserted into the container 10.

It is not necessary that the two radii of curvature which define the edges of the projections 14, one exterior edge being positioned along the interior of the container neck 12 and the other, interior edge 18, extending inwardly towards the center of the container 10, have the same dimension. For example, the curvature of the exterior edges of projections 14 corresponds generally with that of the inner diameter of neck 12, so that the exterior edges of projections 14 are in full contact with the neck 12 of the container 10. This prevents the product from leaking between the inner wall of the container neck 12 and the exterior edge of the projection 14. The radius of curvature of the interior edge 18 should be slightly larger, preferentially not less than about 40 mm (1.56 inches), to provide a sufficiently sized baffle to prevent inadvertent spillage of the contents of the container 10 while maintaining sufficient space to insert a tablespoon into the mouth 12*a* of container 10.

Figure 4:
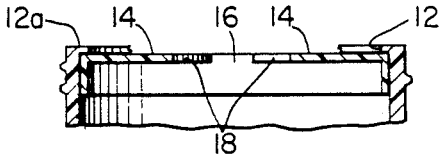
FIG. 4 is a fragmentary vertical sectional view taken along line 4—4 of FIG. 3 showing the edge of the projections.

Referring to FIG. 4, the projections 14 should be rigid enough to not deform under the weight of the product when the container 10 is tipped sideways to effect dispensing of the contents. Projections 14 made of polypropylene or high density polyethylene, having a thickness of ranging from about 0.5 mm (0.020 inches) to 1.5 mm (0.06 inches), preferentially about 1.0 mm (0.04 inches) in the direction of the container axis have been found to work well.

Figure 5:
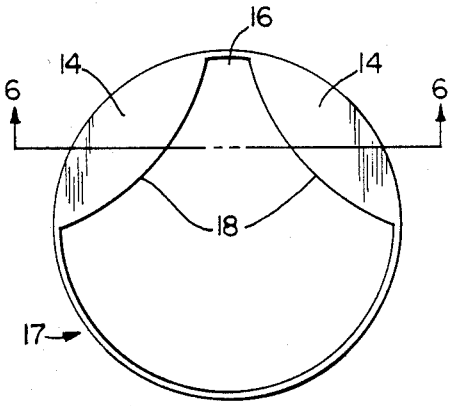
FIG. 5 is a top plan view of another embodiment of the present invention wherein the projections have been molded as one piece with a ring which is inserted in the container body and the dispensing slot is in the twelve o'clock position.
Figure 6:
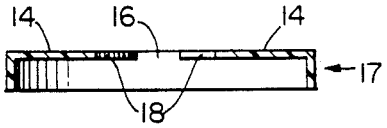
FIG. 6 is a vertical sectional view taken along line 6—6 of FIG. 5 showing the edge of the projections.

Instead of being separate pieces affixed within the neck 12, as described for the embodiment of FIGS. 1-4, or being integrally formed with container 10, the projections 14 can be incorporated into a unitary ring 17, as shown in FIGS. 5 and 6, which is adapted to be attached to or inserted into the container neck 12 with a press-fit and held in place by friction. A ring 17 having an axial dimension of approximately 6.4 mm (0.25 inches), a thickness of approximately 1.25 mm (0.050 inches) and a diametrical interference ranging from about 0.13 mm to +0.13 mm (0.005 inches to +0.005 inches), preferentially about 0.03 mm (0.001 inches) is adequate. A variation is to use a split ring, having an interference fit ranging from about 0.13mm to 0.76 mm (0.005 inches to 0.03 inches), preferentially about 0.13 mm (0.005 inches prior to being inserted in the neck of the container 10. It is necessary to fully insert the ring into the container 10, so that there is not interference with the sealing means. If desired, the ring 17 may be captured between two annular beads (not shown) located on the interior of the neck 12 of the container body to ensure proper positioning. The ring and projections 14 are preferably injection molded of polypropylene or high density polyethylene.

Figure 7:
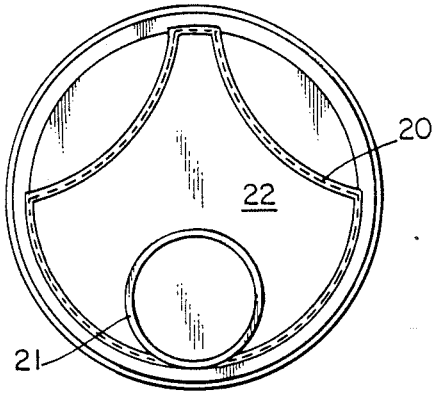
FIG. 7 is a plan view of a further embodiment of the present invention showing a tamper resistant seal which leaves the convex shaped projections upon its removal.

Referring to FIG. 7, the projections 14 can alternatively be made of unremoved portions of a tamper resistant seal 22 which is affixed to mouth 12a and covers the neck opening. The consumer can be instructed to cut the seal material along indicated lines (to remove all seal material other than that corresponding with projections 14, as shown in FIG. 5) or the seal 22 could be provided with a pull ring 21 or other opening device such as described in U.S. Pat. No. 4,467,938 issued to Allen on Aug. 28, 1984. In the latter case, the seal 22 is selectively thinned, or weakened, such that when it is removed from the container 10 the projections 14 remain attached to the neck 12 of the container 10 in their respective positions. This can be accomplished by having tear lines 20 in the seal 22 which define the interior edges 18 of the projections 14 and conform to the balance of the inner periphery of neck 12. The tear lines 20 are thinned to preferentially about 0.2 mm (0.009 inches) but not less than about 0.1 mm (0.003 inches) and not more than about 0.4 mm (0.015 inches). A flexible seal made of low density polyethylene having a thickness ranging from about 0.51 mm to 0.89 mm (0.02 inches to 0.035 inches), preferentially about 0.7 mm (0.026 inches) peripheral bonded to the neck of the container 10 by any suitable FDA approved adhesive is adequate. If desired, the tamper resistant seal 22 may be induction sealed or heat sealed to the neck of the container 10 using known techniques. To facilitate pouring of the granular product, the projections 14 are preferentially symmetrically spaced about a diameter of the container neck 12 for form the dispensing slot 16 mentioned above. The dispensing slot 16 is bounded by the inner perimeter of the container neck 12 and the interior edges of the projections 14. For the granular product described above, a slot 16 having a narrowest width ranging from about 7.5 mm (0.295 inches) to 13 mm (0.5 inches), preferentially about 7.5 mm (0.295 inches), adjacent the container neck 12 is satisfactory. The projections 14 should not be so large as to obstruct of the neck 12 opening, or it will be difficult to insert a spoon into the neck 12 opening to dispense the contents from the container 10. Furthermore, if too much of the neck 12 opening is obscured by integral or preassembled projections 14, filling of the container 10 with the product may be retarded. Generally, the interior edge 18 of the projections 14 should not extend across more than one half of the neck 12 opening in any direction. If it is desired to provide additional restriction against spillage of the contents from the container 10, the interior edges 18 of the projections 14 may be extended, parallel to the longitudinal axis of the container 10, axially downwards towards the bottom of the container 10.

If the projections are not formed from a tamper resistant seal, the projections 14 should be placed at an axial position within the container 10 which does not interfere with the sealing means used to close the container 10. The preferred location in such case is, therefore, slightly below the top of the container neck 12. However the azimuthal orientation of the projections 14, and hence the slot 16, is generally unimportant.

As the diameter of the container 10 neck 12 is changed, the size of the projections 14 should be adjusted accordingly. It has generally been found that this invention is more beneficially used as the size of the container 10 increases.

It is recognized that projections 14 having other shape can be used to form the dispensing slot 16, that more than two projections 14 can be used on a single container, and that additional modifications may e made by one skilled in the art without departure from the spirit and scope of the invention. Furthermore, this invention may be used with containers for liquid and and nongranular products if the dimensions of the projections are adjusted to suit the contents being dispensed.

What is claimed is:

1. In a container for a product, said container comprising a body having a central longitudinal axis and a closed bottom and a neck extending from the top of said body, said neck having a planar mouth at the distal end, the improvement which comprises: a pair of spaced substantially identically shaped transversely extending projections adjacent said mouth, each of said projections having a continuously convex interior edge of substantially uniform radius of curvature intersecting said container body at two points and an axially-downwardly facing surface which is generally normal to the axis of the body, and an axially extending dispensing slot formed between the pair of spaced projections along the interior of said neck.

2. A container according to claim 1 wherein said projections transversely protrude inwardly towards the center of the container in a generally symmetrical fashion.

3. A container according to claim 1 wherein said projections are affixed to a unitary ring which is attached to said neck.

4. A container according to claim 3, wherein said ring is telescoped into the neck and held in place by a friction fit.

5. A container according to claim 1 wherein the projections are molded integrally with the container body.

6. A container according to claim 1 further comprising a removable tamper-resistant seal, wherein said projections comprise the unremoved portions of said tamper-resistant seal which had been formed across the mouth of the container.

7. A container according to claim 1 wherein said dispensing slot has a narrowest width ranging from 7.5 to 13 mm.

8. A container according to claim 1 wherein a spoon can be inserted into the neck of the container.

* * * * *